US011482363B1

(12) United States Patent
Eugene

(10) Patent No.: US 11,482,363 B1
(45) Date of Patent: Oct. 25, 2022

(54) ELECTROMAGNETIC SYSTEM INCLUDING ELECTROMAGNETIC CELLS AND AN ELECTROMAGNETIC PLATE

(71) Applicant: Daniel Junior Eugene, Stamford, CT (US)

(72) Inventor: Daniel Junior Eugene, Stamford, CT (US)

( * ) Notice: Subject to any disclaimer, the term of this patent is extended or adjusted under 35 U.S.C. 154(b) by 0 days.

(21) Appl. No.: 16/576,402

(22) Filed: Sep. 19, 2019

Related U.S. Application Data

(62) Division of application No. 15/188,835, filed on Jun. 21, 2016, now abandoned.

(60) Provisional application No. 62/182,705, filed on Jun. 22, 2015.

(51) Int. Cl.

| | |
|---|---|
| ***H01F 3/00*** | (2006.01) |
| ***H01F 5/04*** | (2006.01) |
| ***H01F 7/20*** | (2006.01) |
| ***H01F 27/02*** | (2006.01) |

(52) U.S. Cl.
CPC ..... *H01F 7/206* (2013.01); *H01F 27/02* (2013.01)

(58) Field of Classification Search
CPC ..... H01F 7/206; H01F 27/02
See application file for complete search history.

(56) References Cited

U.S. PATENT DOCUMENTS

| | | | | |
|---|---|---|---|---|
| 782,312 | A | 2/1905 | Zehden | |
| RE12,700 | E | 10/1907 | Smith | |
| 3,158,765 | A | 11/1964 | Polgreen | |
| 3,976,339 | A * | 8/1976 | Sabnis | F16C 32/0414 310/90.5 |
| 4,255,680 | A * | 3/1981 | Popov | H02K 41/025 310/13 |
| 4,956,625 | A | 9/1990 | Cardone | |
| 5,160,910 | A | 11/1992 | Tsuji | |
| 6,121,709 | A * | 9/2000 | Fathimulla | H02K 1/04 310/216.004 |
| 6,489,871 | B1 * | 12/2002 | Barton | B25B 11/002 335/285 |
| 6,636,153 | B1 | 10/2003 | Barton et al. | |
| 7,782,164 | B2 | 8/2010 | Tiberghien et al. | |
| 8,292,276 | B2 | 10/2012 | Cardone et al. | |
| 2002/0047463 | A1 | 4/2002 | Neuenschwander | |

* cited by examiner

*Primary Examiner* — Bernard Rojas
(74) *Attorney, Agent, or Firm* — Ohlandt, Greeley, Ruggiero and Perle, LLP

(57) ABSTRACT

Disclosed are electromagnetic cells assembled together. The plurality of Electromagnetic Cells are arranged in an electromagnetic plate, the electromagnetic plate can float or hover. The Electromagnetic Plate comprises an enclosure of a first set of alternating layers of electric and dielectric materials. The plurality of electromagnetic cells, each arranged in an individual socket embedded in the holding element inside the Electromagnetic plate, and each electromagnetic cell is comprised of a second set of alternating layers of electric and dielectric materials, and a holding cup cover that screws in to provide structural integrity and an electromagnetic core including a metal tube and electromagnetic coil. At the opening of the Electromagnetic Cell, a tube mechanism can be added which would allow certain liquids to be inserted inside of the cell. The cells heats up as a result of the electric current flowing through the coil inside of the cell, thus resulting in an increased temperature of such liquid.

21 Claims, 17 Drawing Sheets

ELECTROMAGNETIC SYSTEM INCLUDING ELECTROMAGNETIC CELLS AND AN ELECTROMAGNETIC PLATE

CROSS REFERENCE TO RELATED APPLICATIONS

This application is a divisional of patent application Ser. No. 15/188,835 filed on Jun. 21, 2016, which claims priority from and the benefit of provisional patent application number 62/182,705 filed on Jun. 22, 2015. These contents of these prior applications is incorporated herein by reference, in their entireties, for all purposes.

TECHNICAL FIELD

The present invention relates to a system that utilizes electric force to float and transport an article. It can be used in a vacuum, space is a good example. It also can be used as a manner to increase the temperatures of liquids. The present invention relates to a system that utilizes electric force as a propulsion system.

BACKGROUND OF THE INVENTION

The technologies using electrical and magnetic force to float and transport an article are already known to exist.

High-speed transportation patents have already been granted to inventors throughout the world. Early United States patents for a linear motor propelled train were awarded to German inventor Alfred Zehden, whose invention was awarded U.S. Pat. No. 782,312 (14 Feb. 1905) and U.S. Pat. No. RE12,700 (1 Oct. 1907). In 1907, another early electromagnetic transportation system was developed by F. S. Smith. A series of German patents for magnetic levitation trains propelled by linear motors were awarded to Hermann Kemper between 1937 and 1941. An early maglev train was described in U.S. Pat. No. 3,158,765, "Magnetic system of transportation", by G. R. Polgreen. The first use of "maglev" in a United States patent was in "Magnetic levitation guidance system" issued to Canadian Patents and Development Limited.

However, in order for some of the known float to transport technology to work, certain conditions are required such as a metal plated floor system so that a device can float and/or hover over it. Some disclosed float and transport technology have a height limitation. some can be very bulky and heavy and require a lot of expensive parts. Further most of these technologies also consume an enormous amount of energy.

More efficiently and readily applicable ways to utilize electromagnetic force to float and transport an article are needed so that there are more small and medium sized applied float/transport systems available in the marketplace.

SUMMARY OF THE INVENTION

The present invention provides a system, which can transport an article using electromagnetic force rather than any other type of fuel or gas. The system does not contain any moving parts and/or motors, which significantly reduces the chances of malfunctioning and need for maintenance of the system resulting in improved safety.

A primary object of the present invention is to provide an electromagnetic force based transportation system that can be made in any shape or form, and have no limitation as to size, ranging from microscopic to as big as are the end use application's requirements.

Another object of the present invention is to provide an electromagnetic force based transportation system that can hover above any material or surface such as dirt, mud, asphalt, grass or a body of water. The electromagnetic force based transportation system can hover at any height above the surface thereof.

Another object of the present invention is to provide an electromagnetic force based transportation system that has the ability to travel at great speeds and distances using minimal energy and by a very easy to control system. Said system should produce no noise hazard in operation.

Another object of the present invention is to provide an electromagnetic force based transportation system that is flexible and can be integrated into clothing or a fabric that may allow a person to reduce the effective weight of the person who wears it and for being integrated into a piece of medical equipment so as to reduce the weight load of a person's body on their joints.

The invention can be used for many different technologies. That means that it is not restricted to just the use of hovering or as a propulsion system. The Electromagnetic Cells heats up as a result of the electricity going through the coils. At the opening of the cells, a liquid can inserted inside using a tube or some kind of mechanism resulting in that liquid heating up. This particular aspect of this technology can used in the heating of liquids. The wire may be resistive in order to generate heat.

The present invention describes an electromagnetic force based transportation system. Such system comprises an Electromagnetic Plate, which comprises an enclosure of a first set of alternating layers of electric and dielectric materials. Said Electromagnetic Plate further comprises a plurality of Electromagnetic cells, each of which is placed securely in an individual socket in the Electromagnetic Plate through a holding element, wherein the magnetization direction of each Electromagnetic Cell is south to north from the top of the Electromagnetic Plate to the bottom of the Electromagnetic Plate.

The Electromagnetic cell further comprises a second set of alternating layers of electric and dielectric materials surrounding a metal tube core. And the first set of alternating layers of electric and dielectric materials extends horizontally along the plane of the holding element but the second set of alternating layers of electric and dielectric materials extend not only horizontally but also vertically, and perpendicularly to the plane of the holding element.

BRIEF DESCRIPTION OF THE DRAWINGS

The invention will be more readily understood by the following detailed description in conjunction with the accompanying drawings, wherein like reference numerals designate like structural elements, and in which.

DETAILED DESCRIPTION OF EXAMPLES OF EMBODIMENTS

Reference will now be made in detail to the representative embodiments illustrated in the accompanying drawings. It should be understood that the following descriptions are not intended to limit the embodiments to one preferred embodiment. To the contrary, it is intended to cover alternatives, modifications, and equivalents that can be included within the spirit and scope of the described embodiments as defined by the appended claims.

In general, the elements in the figures end with the following digits, although variations are noted below:

Element (1) is a core tip of a core of the Electromagnetic Cell.

Element (2) is a core tip hole.

Element (3) is a bottom holding cup in accordance with the invention.

Element (4) shows the holding cup from the top view showing the center core tip hole.

Element (5) shows bottom alternating layers of electric and dielectric materials.

Element (6) are organic materials used for forming the dielectric parts of the entire product.

Element (7) shows the layers of a metal composition.

Elements (8A and 8B) show the direction of the North and South Pole of the electromagnet when the electrical current flows through the electromagnetic coil. Depending on the use of the technology DC or AC current can be used.

Element (9) shows the holding screw that holds all of the materials in element 5 together and holds the metal or tube to the holding cup 3.

Element (10) is a metal core tube in accordance with the invention.

Element (11) shows the electrical magnetic wire that goes into the metal core tube (10) through small holes and is wound around the metal core tube's center part to create the electromagnet.

Element (12) is the electromagnet coil that is applied on to the center area of the metal core tube.

Element (13) is a hole right above the holding screw ring that aids the electromagnet wire into the core tube winding area.

Element (14) is a wire directly from the top of the E-mag Cell that goes down the alternating layers of electric and dielectric materials having a small light at the end of it.

Element (15) shows a small light source.

Element (16) denotes two portions of the hollow center of the electromagnetic core.

Elements (17) are hollow areas of the Electromagnetic Cell.

The present invention as disclosed herein, describes a plurality of Electromagnetic Cells, substantially doing nothing individually, but when assembled together, for example, when the plurality of Electromagnetic Cells are arranged in an Electromagnetic Plate, the Electromagnetic Plate can float or hover. The Electromagnetic Plate comprises an enclosure of a first set of alternating layers of electric and dielectric materials.

Figure 1:
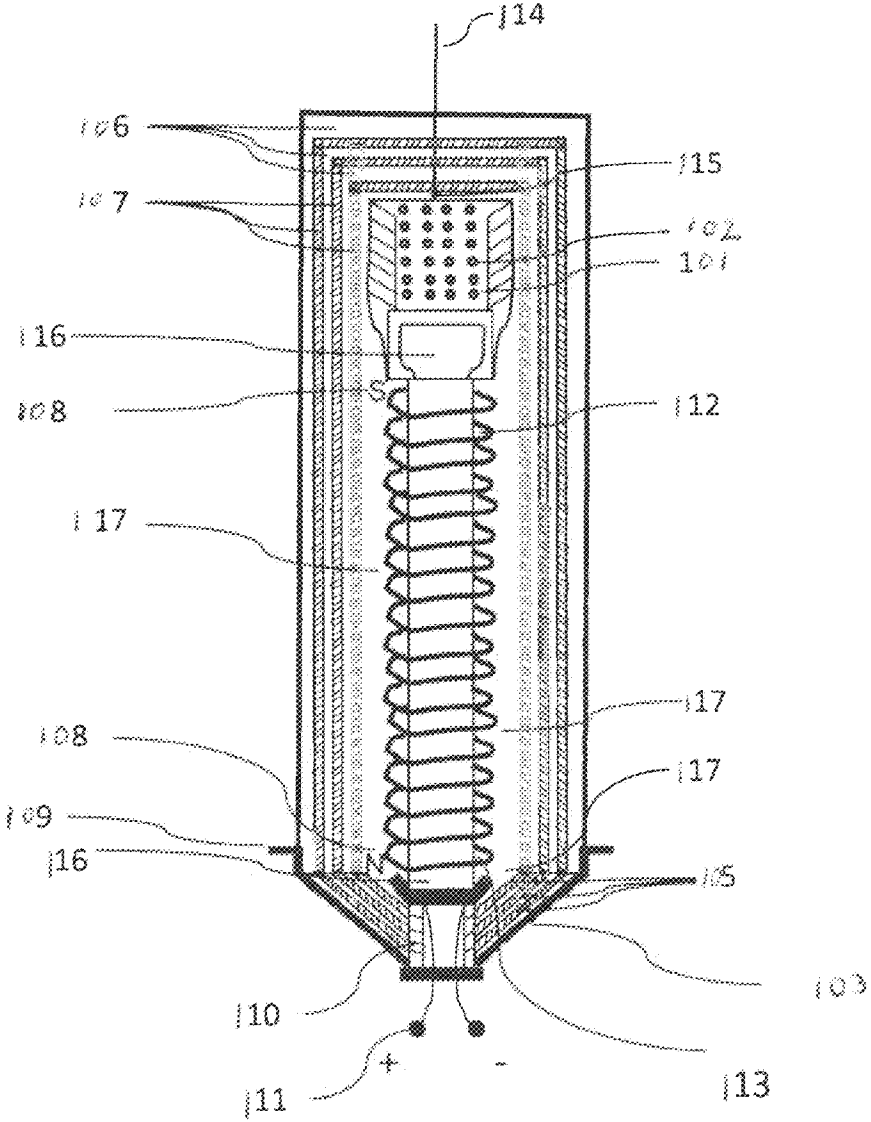
FIG. 1 shows a side view of one Electromagnetic Cell in accordance with the aspects of the present invention.

FIG. 1 shows a side view of an example of an Electromagnetic Cell in accordance with the aspects of the present invention. The electromagnetic Cell comprises a second set of alternating layers of electric and dielectric materials (elements 106 and 107), a holding cup on the bottom (element 103) which screws in to hold the whole piece of Electromagnetic Cell together, an electromagnetic core including a metal tube core (element 110) and electromagnetic coil (element 112), and a small light source (element 115) when the electromagnetic coil surrounds the metal tube core, the electromagnetic coil has a directional winding, so that the electromagnetic coil winds around the metal tube core only from left to right as the electromagnetic coil progresses from top to bottom.

Figure 2:
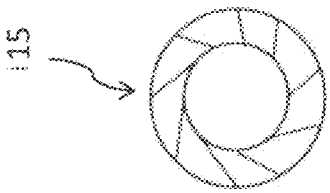
FIG. 2 shows a top view of a hole (element 2 in FIG. 1)

The electromagnetic core further comprises a core tip (element 101), positioned near the top of the Electromagnetic Cell, opposite to where the bottom holding cup (element 103) is located. The core tip is screwed on to the top of the metal tube core (element 110). The core tip comprises a hollow center and multiple core tip holes (elements 102). FIG. 2 shows a top view of the core tip hole. Each core tip hole is a micro-sized hole. The micro holes point downward to the left so that a vortex can form. The vortex pattern of the micro holes are configured to make all the micro holes turn in one direction, for example to the left to form a vertex that is forced downward through the metal core tube 110. As electricity travels through the coil 112A it will cause the core tip to vibrate. The vibration, the electromagnetic field and the energy gathered by the alternating layers like a capacitor will help push energy downwards in the core tube (110).

Figure 3:
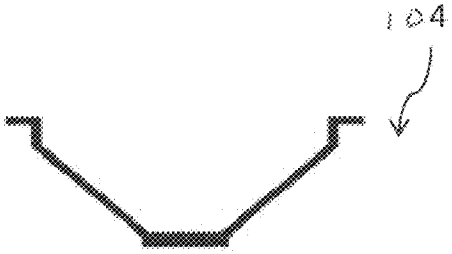
FIG. 3 shows a side view of the holding cup (element 3 in FIG. 1)
Figure 4:
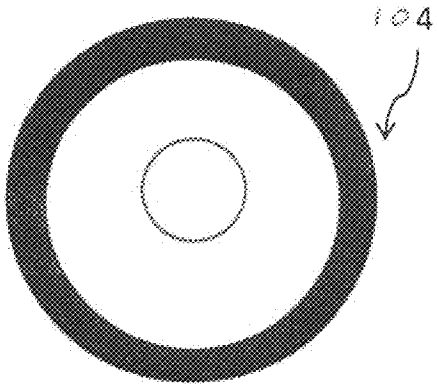
FIG. 4 shows a top view of the holding cup (element 3 in FIG. 1)

The holding cup (element 103) is attached to the alternating layers of electric and dielectric materials (elements 106 and 107) by screws. Referring to FIGS. 1-3, the screw area of the holding cup is located on the inside before the curvature of the cone. The holding cup holds the entire piece together. The holding cup also has an outside lip that holds in each of the electromagnetic cell onto the electromagnetic plate. The holding cup has a wide mouth and narrow base opening. The wide mouth has a diameter of about 3.6 cm. The narrow base opening has a diameter of about 0.7 cm. The holding cup is sized to fit into the outermost layer in the second set of alternating electric and dielectric materials. A holding screw is provided for holding all the materials in element 105 together and holds the metal or tube to the holding cup.

As shown in FIG. 1, the second set of alternating electric and dielectric materials surrounds the electromagnetic core. Alternating electric and dielectric material layers are continuous layers from top to bottom of the electromagnetic cell. In the embodiment shown in FIG. 1, organic material is used for the dielectric layer of the Electromagnetic Cell. The organic material can be fiberglass or carbon fiber. The top layer of the organic material is slightly bigger than the other two organic layers in order to amplify the amount of energy being directed to the electromagnetic core. The organic material can be either fiberglass or carbon fiber.

Metals are used as layers of electric materials. Referring to FIG. 1, the center part of the metal layers is slightly bigger on the top because it will help hold the energy in better. In one example, the metal is galvanized steel.

In accordance with the aspects of the present invention, the direction of the electromagnet when DC current flows through the electromagnetic coil is from the end of the core tip to the end near the holding cup. Referring to FIG. 1, the north pole is near the top of the Electromagnetic Cell and the south pole are near the alternating material layers. When the Electromagnetic Cell is assembled into a plate, the north pole of the Electromagnetic Cell is directed downwardly.

Metal core tube (element 110) is hollow all the way from the top to bottom in the Electromagnetic Cell. The connection area where the metal core tube connects to the core tip is also hollow. The entire electromagnetic core of the Electromagnetic Cell is hollow, which is configured to force energy downwardly in the hollow tube. As electricity flows through the electromagnetic wire, the metal core tube turns into a magnet that increases the power of the electromagnet.

Electrical magnet wire (element 111) that goes into the metal core tube (110) through two small holes and is wound around the metal core tube's center part to create the electromagnet, i.e., the Electromagnetic Coil that goes on the center area of the Metal Core Tube. It is wired from left to right. DC electricity travels up the coil and creates a magnetic field. A frequency is provided to help cause the core tube to vibrate.

A hole (element 113) is right above the holding screw ring that assists the electro magnet wire into the core tube winding area.

A wire (element 114) passes directly from the top of the Electromagnetic cell that goes down the alternating layers of electric and dielectric materials with small light at the end of it.

The small light (element 115) can be any type of energy efficiency lighting which is primarily used for decorative purposes.

Figure 5:
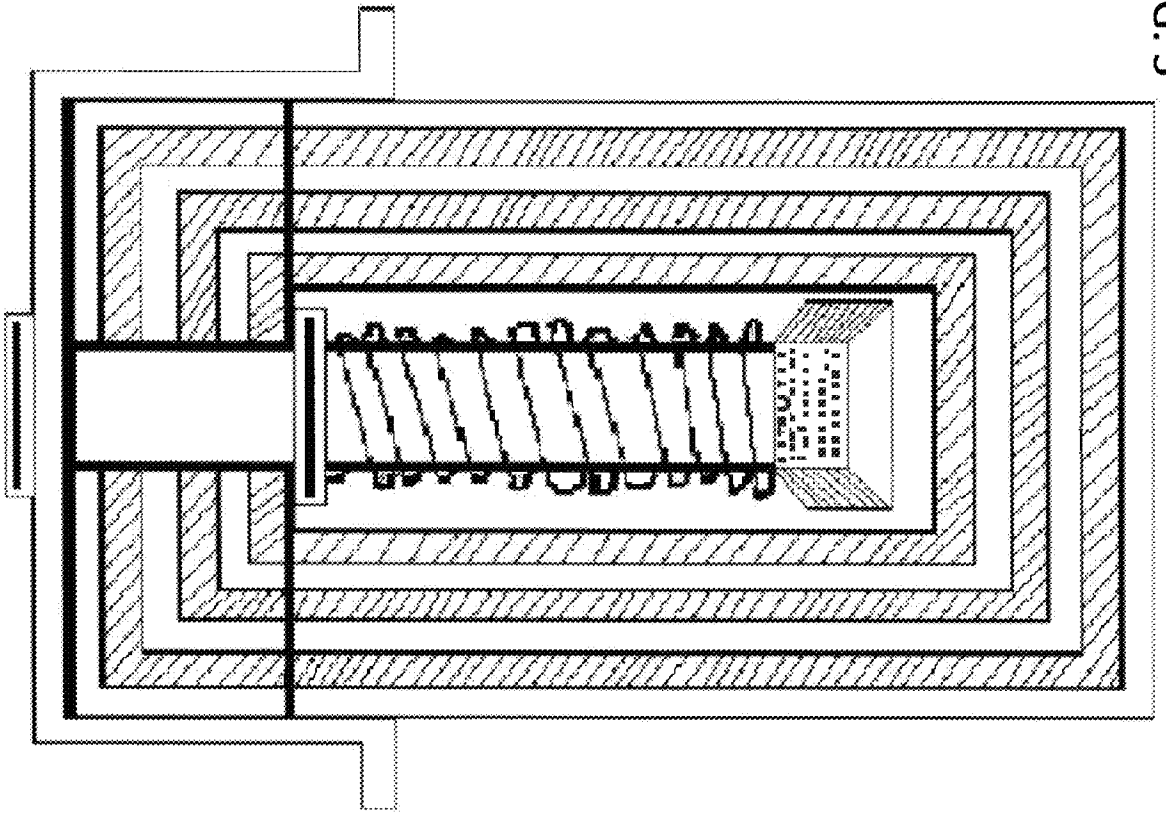
FIG. 5 shows a side view of another Electromagnetic Cell in accordance with the aspects of the present invention.
Figure 6:
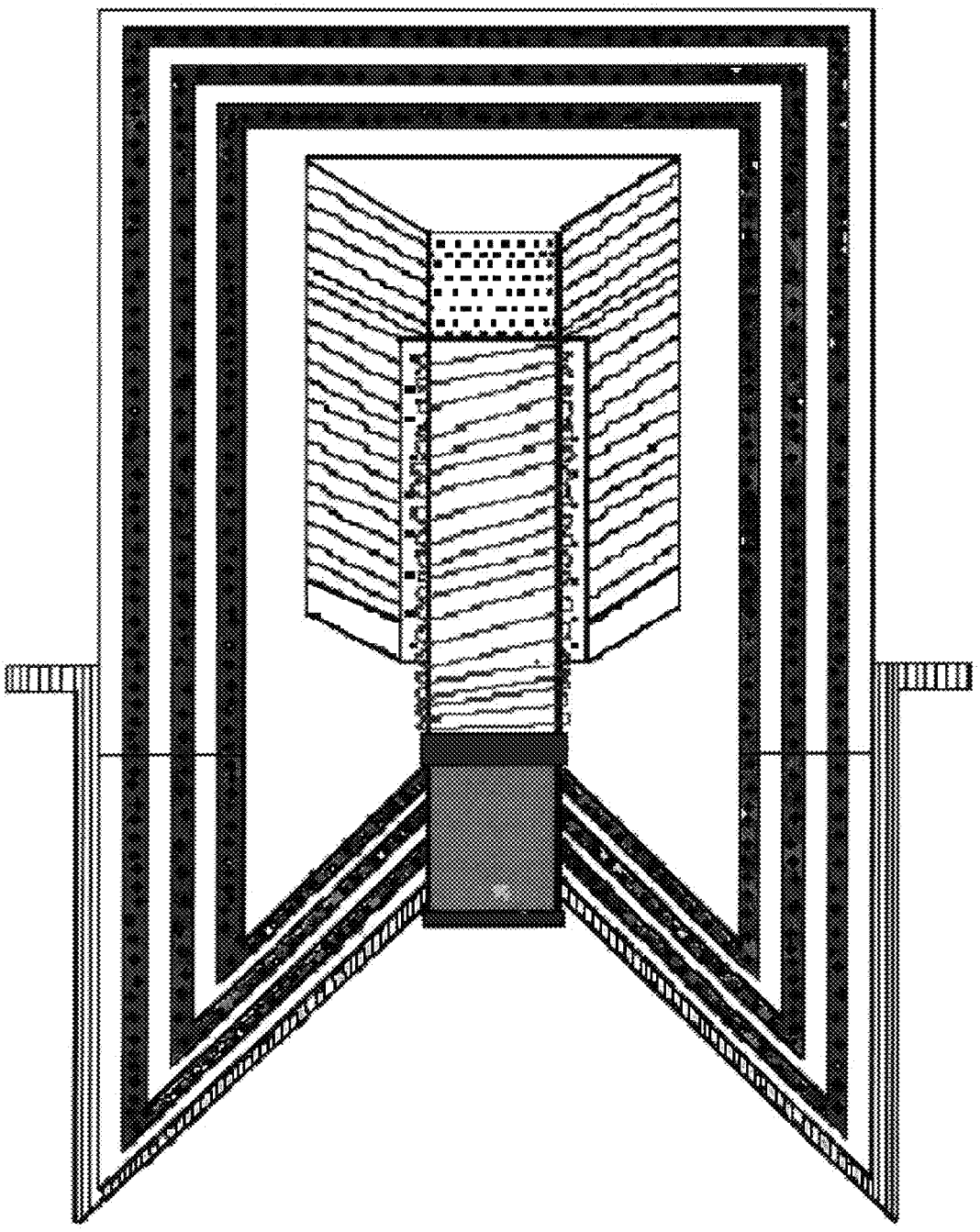
FIG. 6 shows a side view of another electromagnetic cell in accordance with the aspects of the present invention.

FIG. 1 shows one example of an Electromagnetic Cell, wherein a side view of the bottom of the electromagnetic cell is v shaped. The v-shaped bottom is housed in a v-shaped holding cup. FIGS. 5 and 6 show two alternative designs of the of the Electromagnetic Cell, wherein the top and sides of the Electromagnetic Cells are the same whereas the bottom of the Electromagnetic Cell can be either flat as shown in FIG. 5 or be A shaped as illustrated in FIG. 6. Correspondingly, the bottom hold cup can be either flat or A shaped for different purposes.

In accordance with the aspects of the present invention, the Electromagnetic cells are each designed to join with another Electromagnetic Cell in a group as such as in an Electromagnetic Plate to create extraordinary phenomena.

Figure 7:
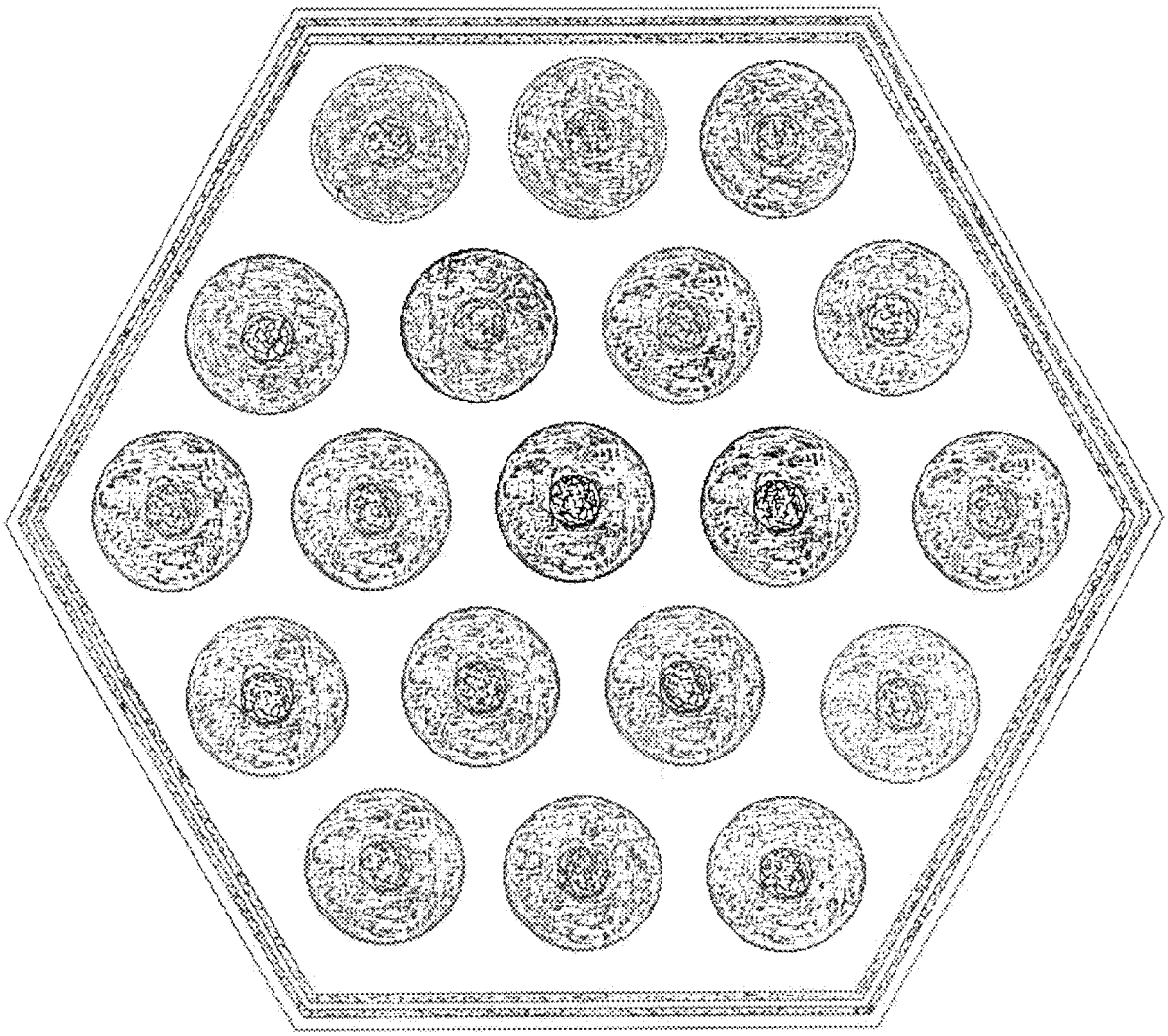
FIG. 7 shows a bottom view of an Electromagnetic Pin accordance with the aspects of the present invention.
Figure 8:
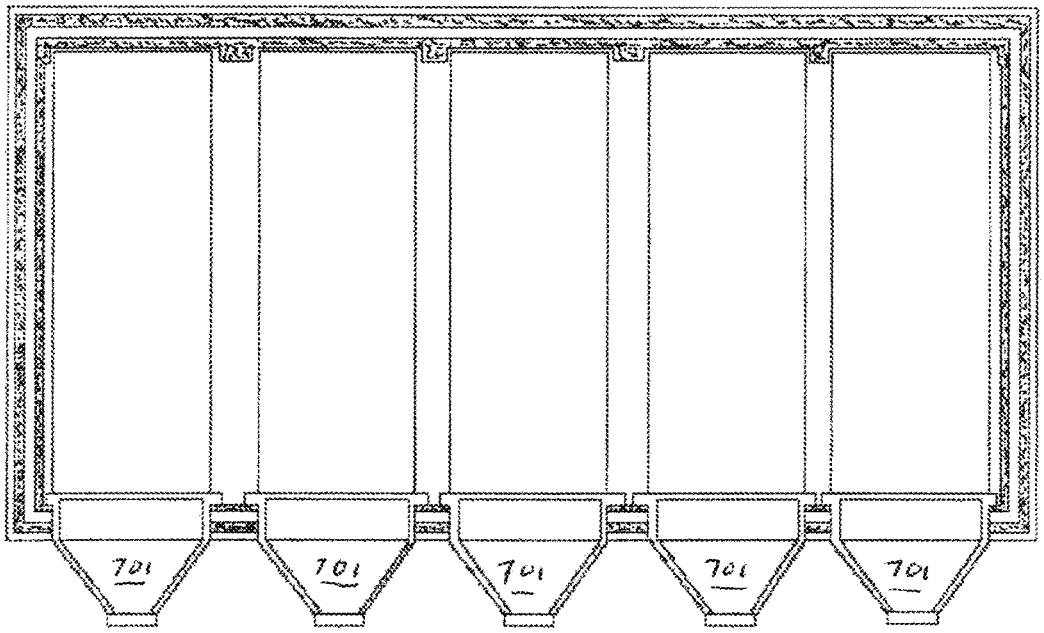
FIG. 8 shows a side view of the Electromagnetic Plate in FIG. 7 with sockets for receiving the electromagnetic cells.

The Electromagnetic Plate, as shown in FIGS. 7 and 8, is an enclosure of alternating layers of electric and dielectric materials. In one embodiment the enclosure of first set of electric and dielectric materials is composed of the same materials as the second set of Electromagnetic Cell. The Electromagnetic Plate has a hexagonal shape with 19 Electromagnetic Cells. All the Electromagnetic Cells are connected to each other, either in parallel or in series. The Electromagnetic Cells are connected using a fault tolerant design, which means if one of the cells were to stop working, the other cell would not be affected. The E-Mag Plate side view drawing shows the directions in which the Electromagnetic Cells are pointing. The internal metal layer of the Electromagnetic Plate contains 19 sockets that allow the Electromagnetic Cells to sit in and be held very sturdily in place. At the bottom of the Electromagnetic Plate there is a cover that holds the Electromagnetic Cells together. The plate can then be placed in a readily available socket for the Electromagnetic Plates to be used.

In one embodiment as shown in FIG. 7 and in additional detail in FIG. 8, an Electromagnetic Plate, comprises a holding element, integrally connected with an enclosure element and made of the same dielectric material as the enclosure element; a plurality of Electromagnetic Cells, each arranged in an individual socket 701 embedded in the holding element, and each Electromagnetic Cell is comprised of a second set of alternating layers of electric and dielectric materials, and a holding cup cover that screws in to provide structural integrity and an electromagnetic core having a metal tube, and a small light; wherein the first set of alternating layers of electric and dielectric materials extends horizontally along the plane of the holding element but the second set of alternating layers of electric and dielectric materials extend not only horizontally but also vertically, perpendicular to the plane of the holding element.

Figure 9A:
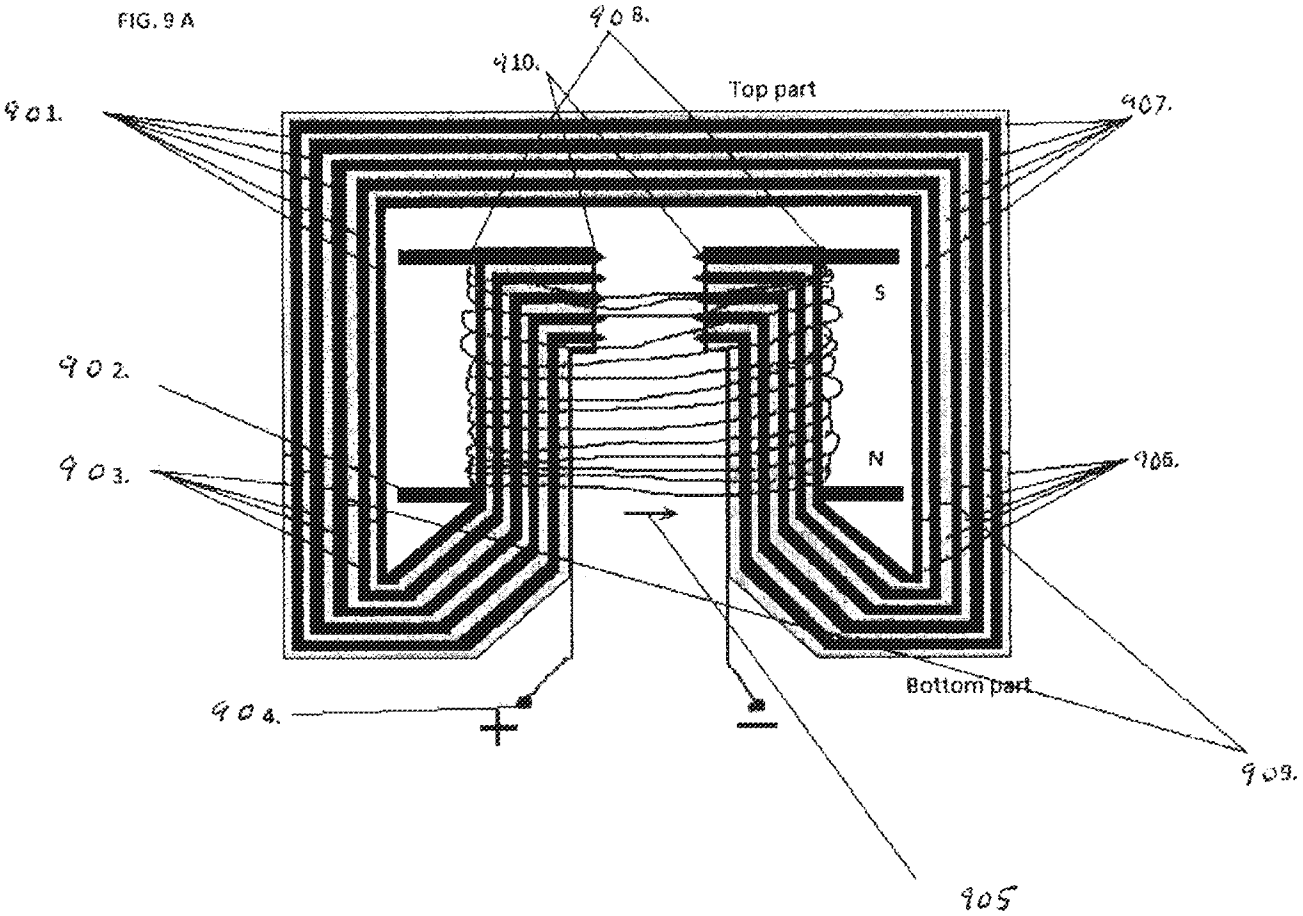
FIG. 9A represent a different way of making the cells without the use of a metal core tube, wherein this representation each of the layers of the electric and dielectric materials are put on top or inside one another to create the Electromagnetic Cell, the Central Core, and the Inner Central Core with pyramid like shaped endings on the horizontal plane.
Figure 9B:
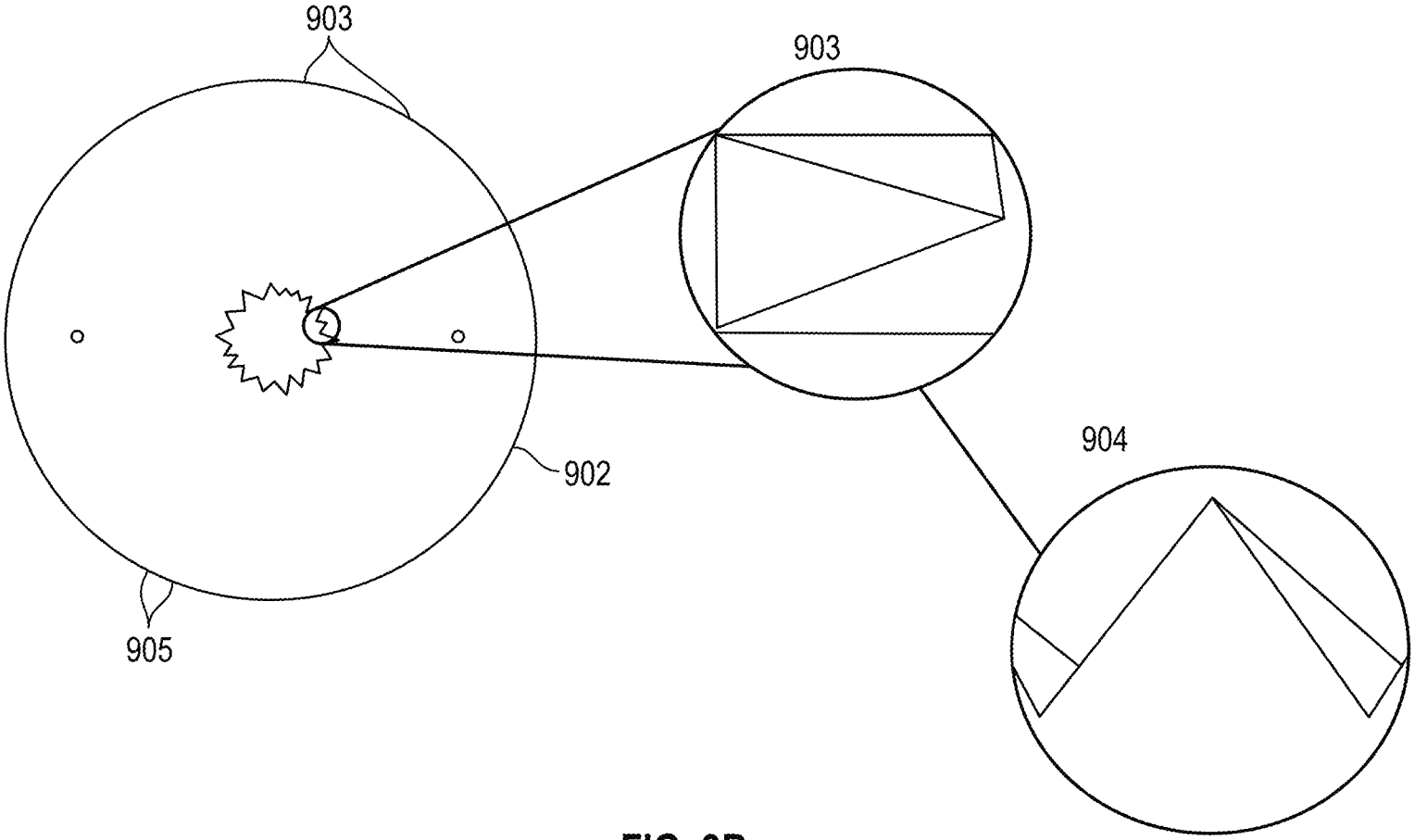
FIG. 9B represents the top view of the Central Core of FIG. 9A
Figure 9C:
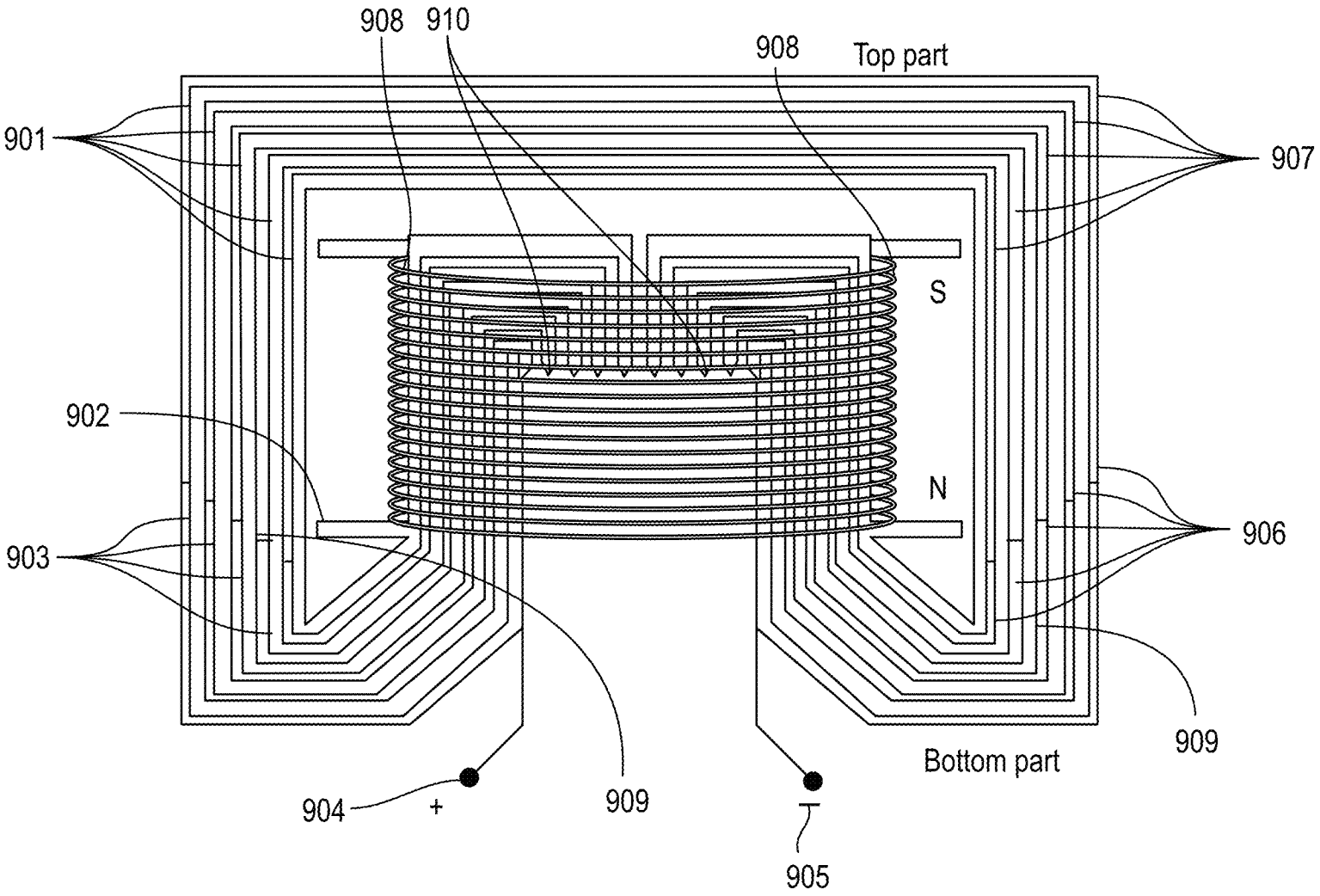
FIG. 9C shows an almost identical version of the FIG. 9A and has all the same elements with the exception of the Inner Central Core where the pyramid like shaped endings are on the vertical plane.

In FIGS. 9A to 9C, each of the layers of the electric and dielectric materials are put on top or inside one another to create the cell's core. There is no metal core tube but the Central Core (element 902) is also part of the entire cell's body. All the layers are connected to one another. It illustrates the side view of the cell that is sliced in half to show the inside of the cell and how it is composed. The thickness of the metals and the dielectric material can vary. The shape of the cell from the top or bottom view is circular. Because of the circular shape the top part and bottom part of the cell can be screwed to each other. The pulsating electrical signal going through the wire will affect the alternating layers of metal in the cell's body. Based on the shape of the cell, the transferred energy from the cell's core will travel through the alternating layers of metal towards the top inside part of the cell near the south pole and escape there. Then the energy will proceed to the cell's opening at the bottom part of the cell. The Holding Cup becomes the central core that is on the vertical plane then the layers makes a ninety degree turn to become horizontal towards the inner central core whereas in FIG. 9C the layers makes a final turn to the vertical plane. FIG. 9C is almost identical to FIG. 9A, with the exception of the inner central core. The elements of both figures are exactly the same. In FIGS. 9A to 9C there are pyramid shaped like endings (elements 910) at every ferromagnetic layers in the inner Central Core of the Electromagnetic Cell to help escape electrical energy. In FIG. 9A the pyramid like endings point to the horizontal plane whereas in FIG. 9C they point on the vertical plane toward the bottom. The number of the sharp pyramid like edges may vary. In this representation the ending are pyramid shaped, but the endings can be shaped differently or they can be without any ending shape and can just be flat.

In this representation like elements represented by like numerals. The elements of FIGS. 9A to 9C are:

Element (901) represents the layers of the metals in the cover portion of the Electromagnetic Cell. Top part. It shows the electric portion of the of the alternating layer of electric and dielectric materials that the cell is composed of.

Element (902) represents the inner centerpiece where the coil will be wrapped around. That central area forms the Central Core of the cell.

Element (903) represents the layers of ferromagnetic metals in the bottom part that will be screwed to the top. The layers starts on the vertical plane then makes a ninety degree turn towards the center followed by a obtuse angle inwards. Then, following the obtuse angle comes a vertical direction of the layers up to make the Central Core. After the vertical angle, a ninety angle of the layers are made towards the central inner core where the layers will end in a pyramid like shaped endings in FIG. 9A. However, in FIG. 9C the layers make another ninety degree angle toward the vertical plane and terminates in pyramid like shaped endings.

Element (904) represents the wire that will go inside of the cell. It will be wrapped around the Central Core.

Element (905) represents the direction in which the wire would be wrapped around the Central Core. It also shows that the wire will be wrapped from the left to the right. In all the cells including previous figures and future figures, the coil can either be wrapped around the core where the wire does not wrapped around itself or it can also be wrapped around the core where the wire is wrapped around itself several times. This representation also shows the poles of the Electromagnetic Cell. It will be north at the bottom and south of the top. This due to the direction of the wrapped wire around the Central core. The wire can be wrapped in any direction from left to right or right to left. But for best results due to the conflict with the electromagnetic field of the cell, it is best to wrap the coil from left to right resulting in the south pole at the top and the north pole at the bottom.

Element (906) represent the dielectric material of the Electromagnetic Cell that fits in one into another. It follows the same angle process of element 3 FIG. 9 A/C.

Element (907) represent the dielectric alternating material of the top cover. It resembles a cup.

90Element (908) represent holes in the area that will be holding the electromagnetic coil. These holes allows the wires to go outside of the cell through the opening at the bottom.

Element (909) represents the area in which the top part of the Electromagnetic Cell and the bottom part would meet. In this manner the part and the bottom part will be screwed to each other since the shape of the cell is circular. Also it is the connection area that the alternating layers of ferromagnetic metal will meet.

Element (910) represents the pyramid like shaped endings on every ferromagnetic layers of the Electromagnetic Cell in the Inner Central Core. This part is the inner Central Core.

FIG. 9B shows the top view of the Electromagnetic cell in FIG. 9A and it also shows the an inner area where the layers of the metals ends in a pyramid shaped inner core endings (Element 902B, 903B, 904B). The sharp pyramid like endings are to help escape the electrical energy coming from the alternating layers of ferromagnetic metals in the Electromagnetic Cell's body as electrical energy is attracted to sharp and pointy areas. It also shows the holes where the wire of element 904 in FIG. 9A will be going through to be wrapped around the central core. It also shows the holes and the area of the central inner core where the wire will be going through (element 901 and 905).

The elements of FIG. 9B are:

Element (901B) represent two holes that the wire will be going through

Element (902B) represent the sharp edged pyramid like shaped endings of the inner central core.

Element (903B) represent the top view of the sharp edged pyramid like shaped endings of the inner central core of the Electromagnetic Cell.

Element (904B) represent the side view of the of the sharp edged pyramid like shaped endings of the inner central core of the Electromagnetic Cell.

Element (905B) represent a path or an area of the central inner core where the wire will be going through.

Figure 10A:
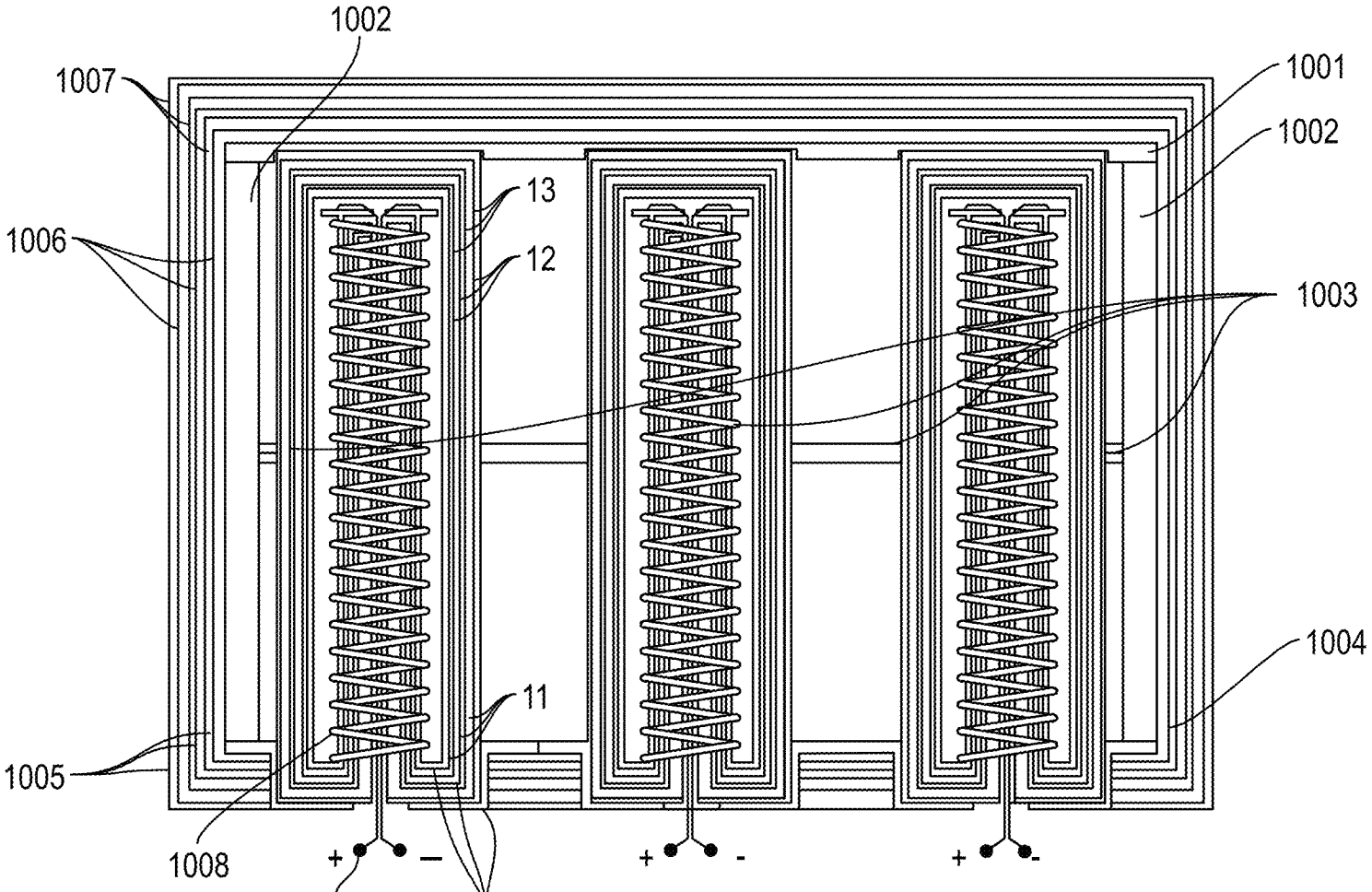
FIG. 10A illustrates a fully assembled Electromagnetic Plate with the cells in their proper place.
Figure 10B:
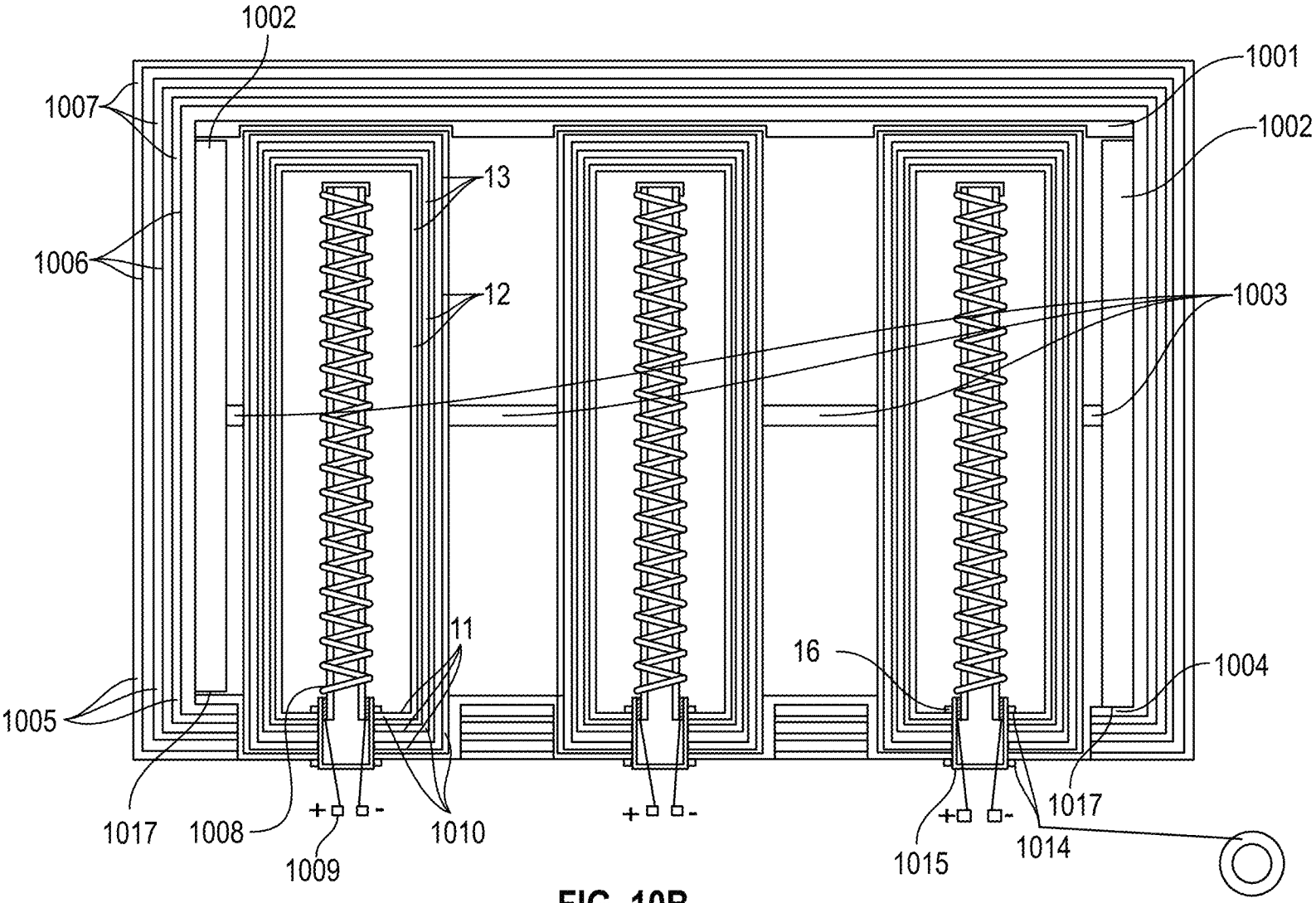
FIG. 10B shows an almost identical Electromagnetic Plate as in FIG. 10A with the exception of Central Core of the cells that is not a metal core tube but the alternating layers of electric and dielectric material that is part of the cell's body as all the layers of are connected.

FIGS. 10A and 10B shows two different types of cells inside of an Electromagnetic plate. It shows a cross-sectional view of both cells and the Electromagnetic Plates. In FIG. 10A the cell's core is an alternating layer of electric and dielectric material that is also connected to the rest of the body of the cell itself. FIG. 10B shows the original Electromagnetic Cell with the metal core tube that is insulated from the rest of the cells body. In the figures liked component are used by liked numerals. These figures' elements are:

Element (1001) represent a holder that holds the cells in place to prevent them from moving around inside of the plate. It is located at the top. It is made of a dielectric material that has short round holes that is just enough to fit the top part of a cell into it. It also has the shape of the plate. As the cells fits right into it, it will be served as support to all the cells in the plate.

Element (1002) represents a holder with holes at that holds the cells in place. It holds the center area of the Cell Holder that has the holes to hold the cells in place.

Element (1003) represents the center an area that has the holes in to hold the cells in place.

Element (1004) represent the Holding Cup of the Electromagnetic Cell. It acts as a cap is screwed to the body of the cell which holds all the pieces together. The layers of metal in the Holding Cup is connected to the layers of metal in the cell's body.

Element (5) Represents the holding cover of the Electromagnetic Plate. It seals the cells inside of the Electromagnetic Plate. It shows the dielectric material of the plate cover. It is also accompanied by the metals of the plates cover. The metals that are part of the plate cover are layers of ferromagnetic metals. In this example three layers are used for the electric and dielectric materials. All the layers are connected to one another.

Element (1006) represents the alternating layers of ferromagnetic metal in the body of the Electromagnetic Plate.

Element (1007) represents the alternating layers of dielectric material in the body of the Electromagnetic Plate.

Element (1008) represents the coil that is wrapped from left to right inside of each of the cells located in the Electromagnetic Plate.

Element (1009) represents the positive electrical wire of the cell.

Element (1010A) in FIG. 10A, represents the altering layer of dielectric materials in the cells' holding cap but in this situation the holding cap is also the Central Core of the Electromagnetic Cell.

Element (1010B) in FIG. 10B, represents the altering layer of dielectric materials in the cells holding cap. In this version the metal core to be screwed in with the holding cap.

Element (1011A) Represents the alternating layers of ferromagnetic metal that is part of the cell's core.

Element (1011B), in FIG. 10B, represents the alternating layer of ferromagnetic metals that is part of the holding cap.

Element (1012) represents the alternating layers of ferromagnetic metals that are part of the cell body.

Element (1013) represents the dielectric layers that are part of the cell body Element (1014B), in FIG. 10B, represents the holding screws that will hold the metal core tube in place.

Element (1015B), in FIG. 10B, represents the metal core tube.

Element (1016B), in FIG. 10B, represents holes in the metal core tube that allow the coil to go inside of the Electromagnetic Cell.

Element (1017B), in FIG. 10B, represents the area in which the electromagnetic plate cover and the Electromagnetic Plate's body meets.

Figure 11:
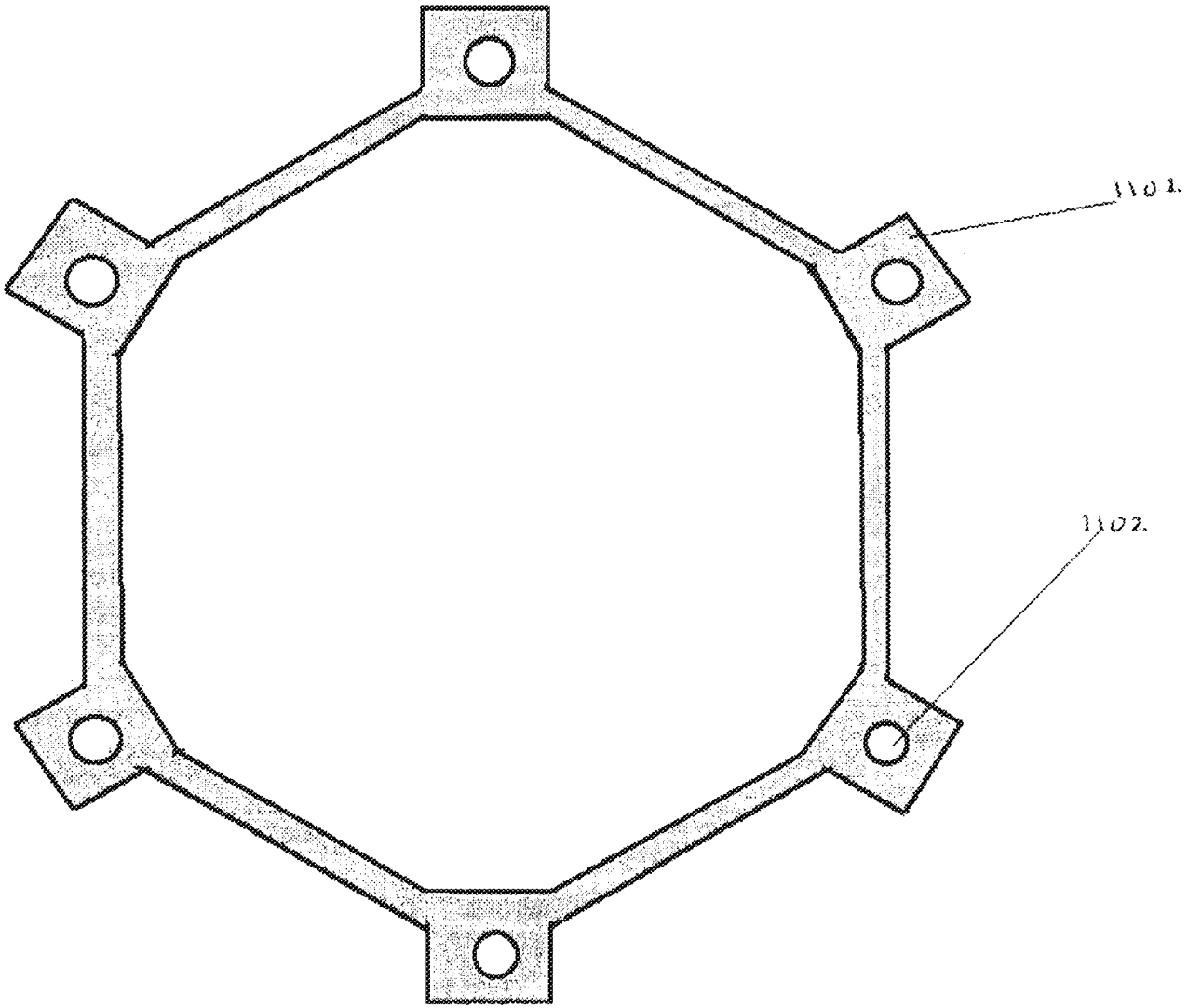
FIG. 11 demonstrates a holder that holds the Electromagnetic Plate together.

FIG. 11 represents a holder with indentation that holds the Electromagnetic Plate. Deep indentation allows the cover part of the Electromagnetic Plate to partially go inside of the Electromagnetic Plate holder. In that way, it holds the entire piece in place. This figure's elements are:

Element (1101) represents the plate holder.

Element (1102) represents holes in that allows screws to hold the whole piece together.

Figure 12:
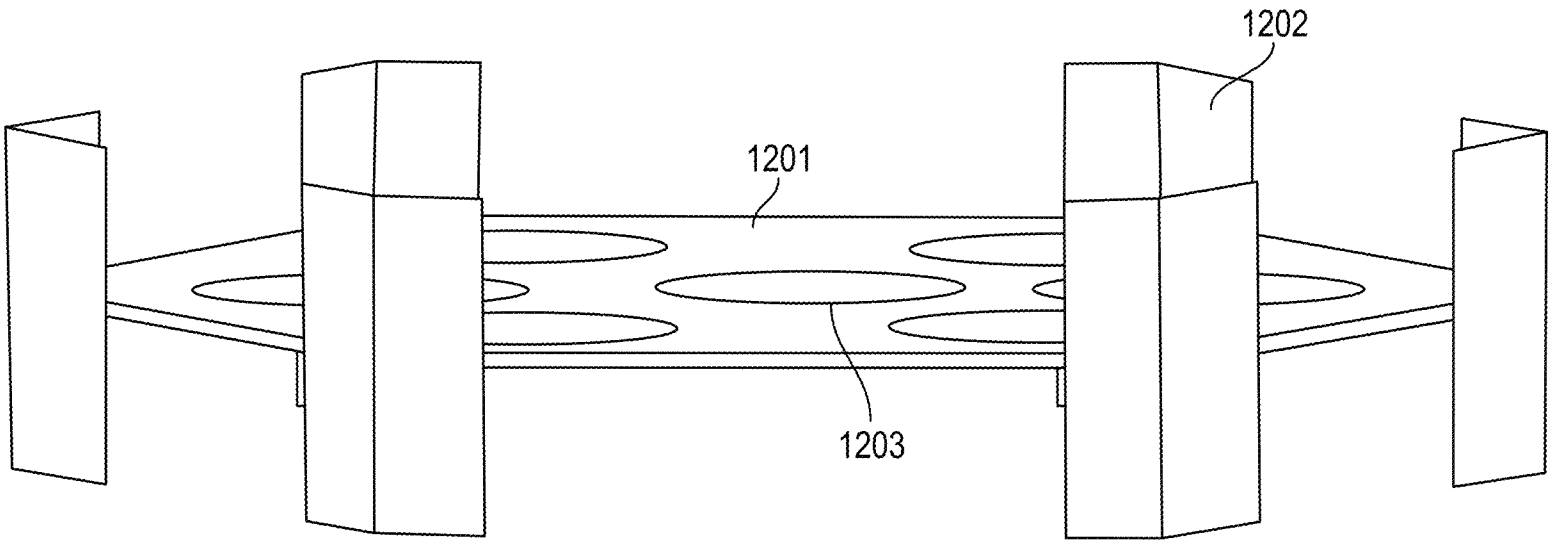
FIG. 12 represent a Cell Holder.

FIG. 12 represents a cell holder. In this figure the cell holder has holes that holds the cells together inside of the Electromagnetic Plate. The entire piece can be made of plastic, or heat resistant material. This figure's elements are:

Element (1201) represents the piece that has the holes that holds all the cells together in place.

Element (1202) represent the corner pieces that are located at the corners inside of the Electromagnetic Plate.

Element (1203) represent the holes that are inside of the piece that holds all the cells together.

Figure 13:
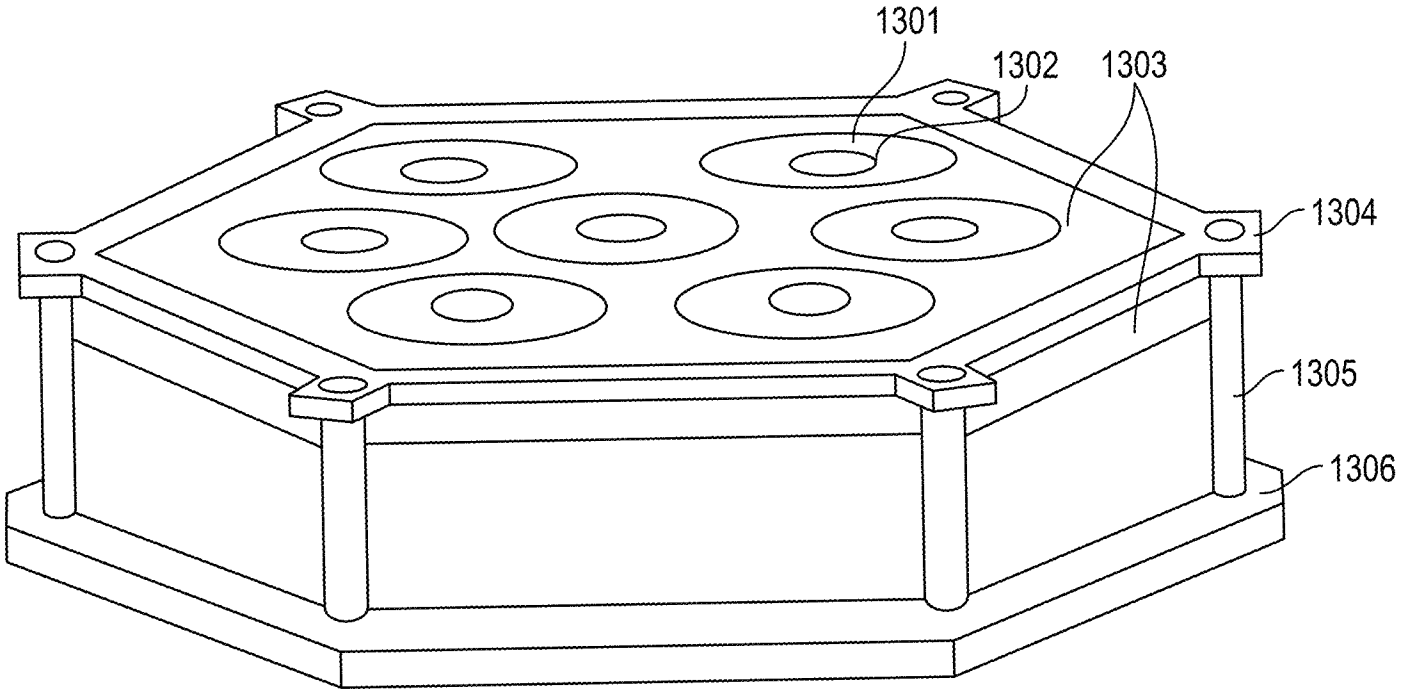
FIG. 13 represents a 3 dimensional (3D) view of a fully assembled Electromagnetic Plate that is upside down.

FIG. 13 Is a 3D representation of a fully assembled Electromagnetic Plate. The plate is upside down. The shape of the Electromagnetic Plate may vary due to the number of cells it is composed of. This figure's elements are:

Element (1301) represents the cells that are in the Electromagnetic Plate. In this representation there are seven cells inside of the plate. The Electromagnetic Plate consist of two or more cells.

Element (1302) represents the opening or hole in the cell.

Element (1303) represents the plate cover.

Element (1304) represents Electromagnetic Plate's cover holder. Combined with the screw and the holding area, this piece holds the entire Electromagnetic Plate together.

Element (1305) represents a screw that goes through the plate holder to hold the whole piece together.

Element (1306) represents the holding area that holds the entire piece together.

Figure 14:
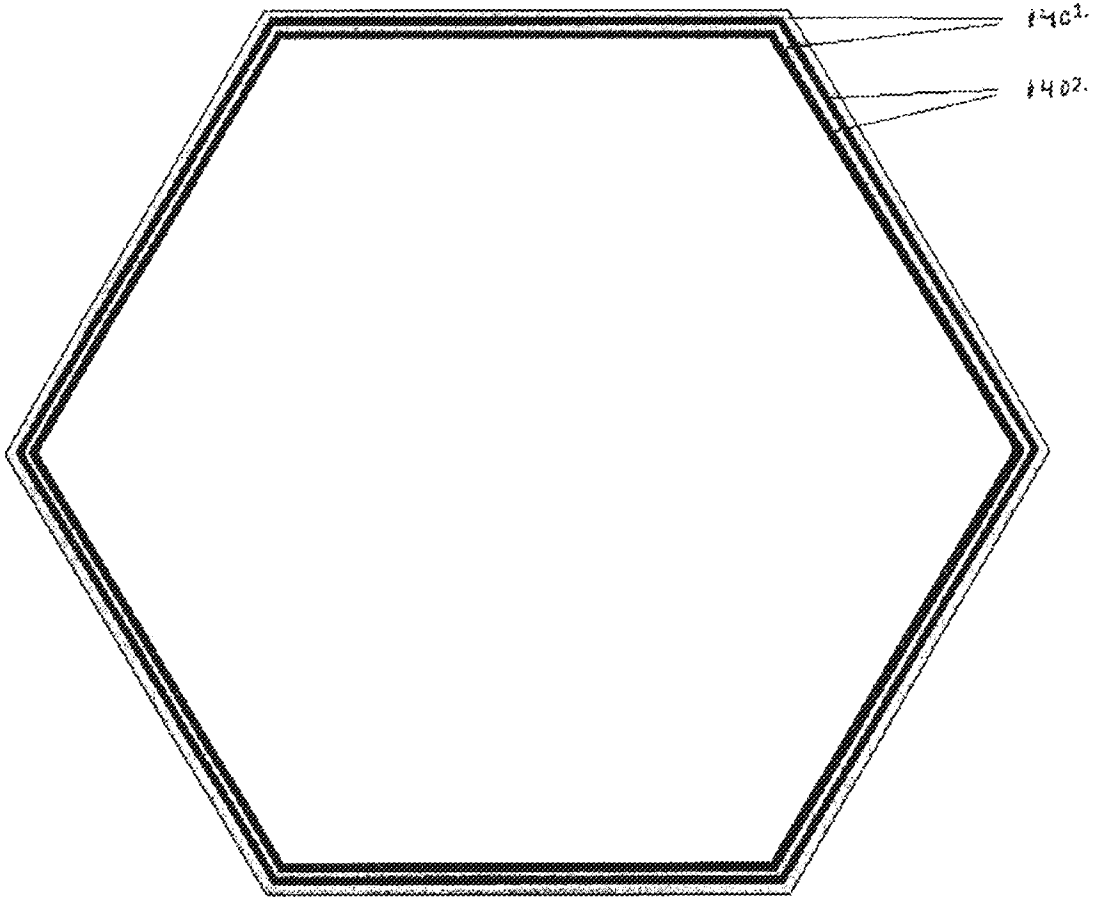
FIG. 14 represent cover top of the plate.

FIG. 14 represents the plate cover from the bottom view. In this representation the plate cover only has two layers of dielectric and two layers of ferromagnetic metal. The size of the layers and the number of the layers can vary. This figure's elements are:

Element (1401) represents the dielectric layers of the cover.

Element (1402) represents ferromagnetic layers of the cover.

Figure 15:
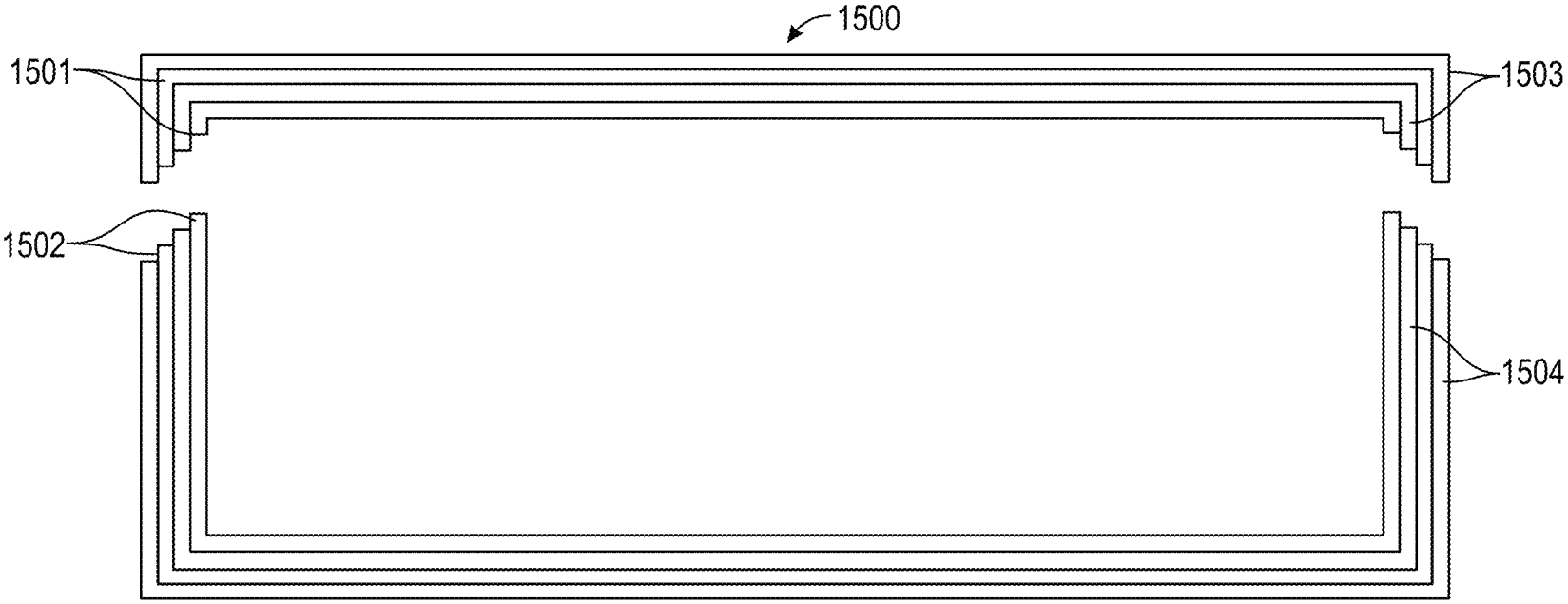
FIG. 15 shows the Electromagnetic Plate body having a configuration with a cap or cover.

FIG. 15 represents a two-layer configuration of the plate cover and plate body. The size of the layers and the number of the layers can vary. This figure's elements are:

Element (1501) represents the alternating layers of ferromagnetic metal in a plate cover 1500.

Element (1502) represents the alternating layers of ferromagnetic metal in the plate body.

Element (1503) represents the alternating layers dielectric material in the plate cover.

Element (1504) represents the alternating layers of dielectric material in the body of the plate.

Figure 16:
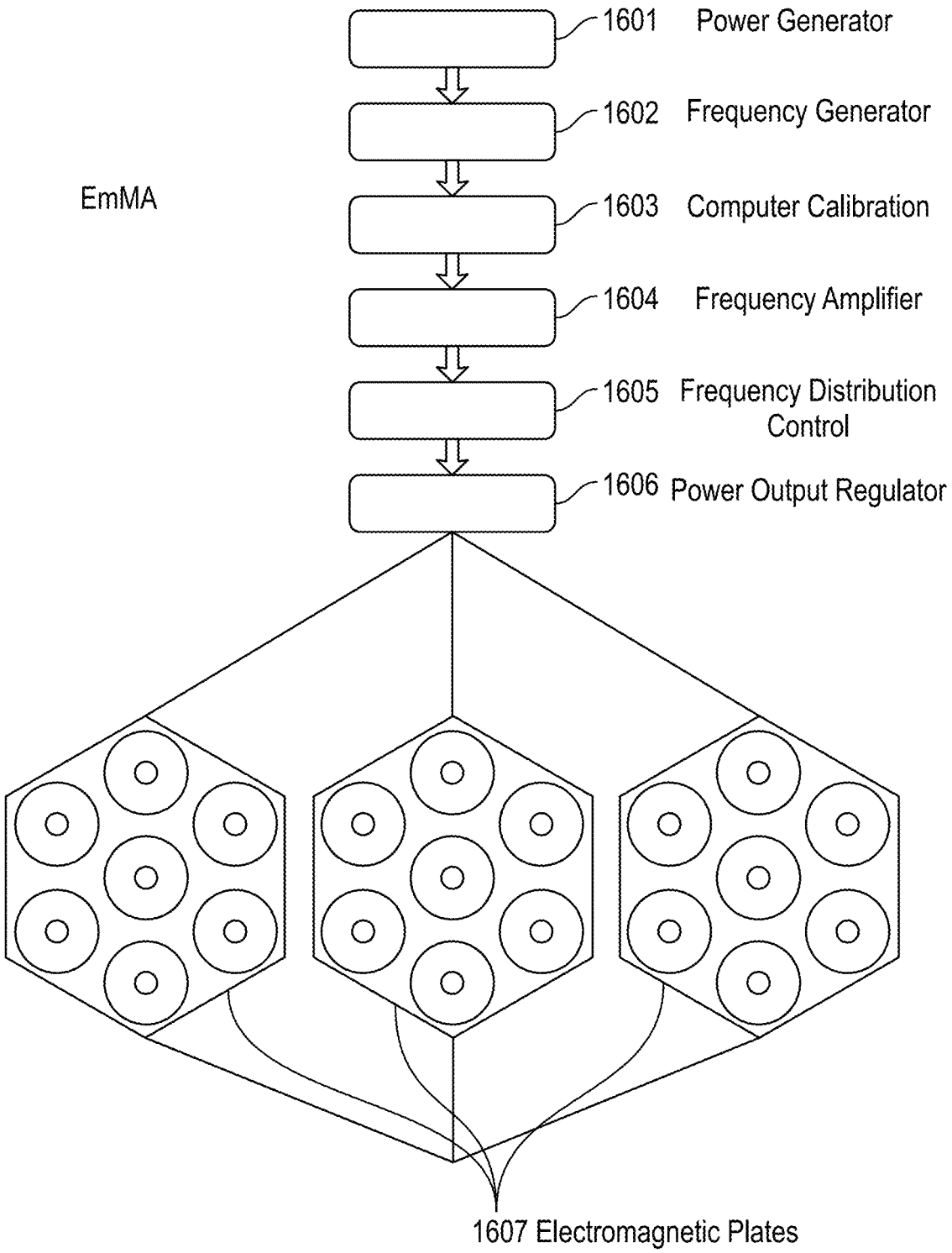
FIG. 16 represents EmMA (Electromagnetic Modulation Amplifier) which is the system that powers the cells.

FIG. 16 represent EmMA (Electromagnetic Modulation Amplifier). It is a system that powers and controls the Electromagnetic Cells. The different parts have different functions Element (1601) represents the Power Generator which is the source of power for the entire system.

Element (1602) represents the Frequency Generator which creates a frequency that resonates with the cells. Depending on the type of cells and their composition, the frequency to get the cells to operate may vary.

Element (1603) represents the Computer Calibration System calibrates the frequency coming from the Frequency Generator.

Element (1604) represent the Frequency Amplifier that amplifies the frequency coming from the frequency generator to such degree as to power each of the Electromagnetic Cells.

Element (1605) represents a Frequency Distribution Control System which is used to split the power output to different Electromagnetic plate sections or clusters.

Element (1606) represents the Power Output Regulator. This is the true control system of EmMa. It regulates the power input of each Electromagnetic Plate separately. In this condition one Electromagnetic Plate might have more power than another adjacent plate. Because of the difference in energy output of the Electromagnetic Plate due to the difference in energy input per plate, the propulsion power per plate maybe different. This allows the user to control the mechanism's movements.

Element (1607) represents clusters of E-mag Plates. Based on the mechanism that the plates are part of, the number of plates used may vary.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not meant to be exhaustive or to limit the embodiments to the precise forms disclosed. It will be apparent to one of ordinary skill in the art that many modifications and variations are possible in view of the above teachings.

The advantages of the embodiments described are numerous. Different aspects, embodiments or implementations can yield one or more of the following advantages. It is intended by the appended claims to cover all such features and advantages of the invention. Further, since numerous modifications and changes will readily occur to those skilled in the art, the embodiments should not be limited to the exact construction and operation as illustrated and described. Hence, all suitable modifications and equivalents can be resorted to as coming within the scope of the invention.

What is claimed is:

1. A system comprising:

an electromagnetic cell having a cylindrical an enclosure defined by an outer wall formed of alternating electrically conductive magnetic layers and layers of a dielectric material to form a closed space, wherein the outer wall forms a core within the closed space of the enclosure;

an electrically conductive coil disposed around the core so as to be positioned in the closed space; and a plurality of electrical conductors for supplying an electrical current to the coil.

2. The system of claim 1, wherein ends of the electrically conductive magnetic layers include pyramid shaped ends and the pyramid shaped ends of the electrically conductive magnetic layers are arranged about a central axis of if the enclosure and point in a direction parallel to the central axis.

3. The system of claim 2, wherein the ends of the pyramid shapes of the electrically conductive magnetic layers are disposed toward a central axis of the enclosure.

4. The system of claim 2, wherein the ends of the pyramid shapes of the electrically conductive magnetic layers are disposed toward an end of the enclosure.

5. The system of claim 1, wherein the core is shaped to define an opening in the enclosure, the opening leading to a space within the enclosure for receiving, via the opening, a liquid within the enclosure, and wherein temperature of the liquid is increased when the coil conducts electricity.

6. The system of claim 1, wherein an innermost electrically conductive magnetic layer has a first planar member extending therefrom and a second planar member extending therefrom, the first planar member and the second planar member defining a space around the core, the conductive coil being disposed within the space.

7. The system of claim 1, wherein the system is part of an article of clothing.

8. The system of claim 1, wherein the system is part of a car bumper.

9. The system of claim 1, wherein the system is part of a transportation system.

10. The system of claim 1, wherein the system is part of a weight reduction system.

11. The system of claim 1, wherein the electromagnetic cell operates in a vacuum like or in outer space.

12. The system of claim1, wherein the number of alternating layers may vary due to requirement of technology that it is used for.

13. The system of claim 1, wherein the dielectric material is an organic material, including a fiberglass or carbon fiber.

14. The system of claim 1, wherein the electrically conductive magnetic layers are formed of a metal including galvanized steel or conductive magnetic metal.

15. The system of claim 1, further comprising:

a mounting plate; and a plurality of cups in the mounting plate, each cup being for receiving an end of one of the enclosures.

16. The system of claim 15, wherein coils of the respective cells are connected to each other in parallel.

17. The system of claim 15, wherein coils of the respective cells are connected to each other in series.

18. The system of claim 15, wherein coils of the respective cells are connected to each other in fault tolerant design.

19. The system of claim 15, wherein the mounting plate is comprised of alternating layers of electric material and dielectric material.

20. The system of claim 1, further comprising a metal core tube within the enclosure, the coil being wound around the metal core.

21. The system of claim 1, further comprising:

a holding cup to provide structural integrity affixed to the wall at an end of the cell;

a conductive magnetic material disposed within the electromagnetic cell and affixed to the holding cup;

an opening in the enclosure leading to a space within the enclosure for receiving, via the opening, a liquid within the enclosure, and wherein temperature of the liquid is increased when the coil conducts electricity.

* * * * *